US011473375B2

(12) United States Patent
Bauer et al.

(10) Patent No.: US 11,473,375 B2
(45) Date of Patent: Oct. 18, 2022

(54) WORKING MACHINE AND METHOD FOR WORKING THE GROUND

(71) Applicant: BAUER Maschinen GmbH, Schrobenhausen (DE)

(72) Inventors: Sebastian Bauer, Schrobenhausen (DE); Christian Fischer, Kissing (DE); Andreas Schober, Wertingen (DE)

(73) Assignee: BAUER MASCHINEN GmbH, Schrobenhausen (DE)

( * ) Notice: Subject to any disclaimer, the term of this patent is extended or adjusted under 35 U.S.C. 154(b) by 102 days.

(21) Appl. No.: 16/323,635

(22) PCT Filed: Jul. 12, 2017

(86) PCT No.: PCT/EP2017/067529
§ 371 (c)(1),
(2) Date: Feb. 6, 2019

(87) PCT Pub. No.: WO2018/036713
PCT Pub. Date: Mar. 1, 2018

(65) Prior Publication Data

US 2019/0169941 A1 Jun. 6, 2019

(30) Foreign Application Priority Data

Aug. 24, 2016 (EP) ..... 16185467

(51) Int. Cl.
*E21B 17/07* (2006.01)
*E21B 19/16* (2006.01)
(Continued)

(52) U.S. Cl.
CPC ..... *E21B 17/07* (2013.01); *E21B 7/02* (2013.01); *E21B 7/027* (2013.01); *E21B 19/165* (2013.01); *E02D 27/12* (2013.01); *E21B 7/021* (2013.01)

(58) Field of Classification Search
CPC ..... E21B 17/07; E21B 19/165; E21B 7/02; E21B 7/027
See application file for complete search history.

(56) References Cited

U.S. PATENT DOCUMENTS 5,630,477 A 5/1997 Minatre
7,640,998 B2 1/2010 Howell, Jr.
(Continued)

FOREIGN PATENT DOCUMENTS

DE 20 57 101 B1 2/1972
DE 36 12 762 A1 10/1987
(Continued)

OTHER PUBLICATIONS

Russian Search Report issued in PCT/EP2017/067529; dated Dec. 16, 2019.
(Continued)

*Primary Examiner* — Blake Michener
*Assistant Examiner* — Theodore N Yao
(74) *Attorney, Agent, or Firm* — Studebaker & Brackett PC

(57) ABSTRACT

The invention relates to a working machine and a method for working the ground with the working machine, having a mast, along which, by means of a positioning means, a rotary head is moved vertically, by which a telescopic Kelly rod having at least two Kelly bars is displaced and guided. According to the invention the Kelly bars are locked or unlocked automatically by means of a control, wherein by means of a first detection means a rotation angle of at least one Kelly bar is detected and/or by means of a second detection means a force, torque or pressure change is detected in a hydraulic system. By the control a locking and/or unlocking of the Kelly bars is determined depending on the detected rotation angle and/or the detected change.

10 Claims, 2 Drawing Sheets

(51) Int. Cl.
*E21B 7/02* (2006.01)
*E02D 27/12* (2006.01)

(56) References Cited

U.S. PATENT DOCUMENTS

| | | | | |
|---|---|---|---|---|
| 2004/0216928 | A1* | 11/2004 | Bauer | E21B 17/00 175/320 |
| 2008/0125876 | A1* | 5/2008 | Boutwell | E21B 19/16 166/77.51 |
| 2011/0290564 | A1* | 12/2011 | Agostini | E21B 7/021 175/162 |
| 2012/0072081 | A1* | 3/2012 | Lanzl | E21B 7/022 701/50 |
| 2014/0151078 | A1* | 6/2014 | Bettini | E02D 7/00 173/1 |
| 2016/0348500 | A1* | 12/2016 | Piscsalko | G01V 11/002 |
| 2017/0009530 | A1* | 1/2017 | Homma | E21B 21/015 |
| 2017/0204633 | A1* | 7/2017 | Hubener | E02D 7/10 |
| 2018/0334856 | A1* | 11/2018 | Fontana | E21B 47/09 |

FOREIGN PATENT DOCUMENTS

| | | | | |
|---|---|---|---|---|
| DE | 196 26 223 | A1 | 1/1998 | |
| DE | 10 2012 019 850 | A1 | 4/2014 | |
| DE | 102012019850 | A1 * | 4/2014 | E21B 19/16 |
| EP | 0 947 664 | A2 | 10/1999 | |
| EP | 1 247 778 | A2 | 10/2002 | |
| EP | 1 580 398 | A1 | 9/2005 | |
| EP | 2 390 458 | A1 | 11/2011 | |
| GB | 2376248 | A * | 12/2002 | E21B 17/021 |
| JP | H04-202996 | A | 7/1992 | |
| JP | H08-199966 | A | 8/1996 | |
| JP | 2001-329778 | A | 11/2001 | |
| RU | 2260666 | C1 | 9/2005 | |
| RU | 2313650 | C2 | 12/2007 | |
| RU | 2327024 | C2 | 6/2008 | |
| RU | 2417873 | C2 | 5/2011 | |
| RU | 157403 | U1 | 12/2015 | |

OTHER PUBLICATIONS

An Office Action issued by the Russian Patent Office dated Dec. 20, 2019, which corresponds to Russian Patent Application No. 2019103255/03(005953) and is related to U.S. Appl. No. 16/323,635.

International Search Report issued in PCT/EP2017/067529; dated Oct. 17, 2017.

Notification of Transmillal of Translation of the International Preliminary Report on Patentability and Translation of the International Preliminary Report on Patentability (Chapter II) issued in PCT/EP2017/067529; dated Dec. 19, 2018.

An Office Action mailed by China National Intellectual Property Administration dated Mar. 4, 2020, which corresponds to Chinese Patent Application No. 201780051769.8 and is related to U.S. Appl. No. 16/323,635 with English language translation.

An Office Action; "Notice of Reasons for Refusal," mailed by the Japanese Patent Office dated Apr. 7, 2020, which corresponds to Japanese Patent Application No. 2019-510964 and is related to U.S. Appl. No. 16/323,635 with English language translation.

An Office Action mailed by the Indian Patent Office dated Feb. 26, 2021, which corresponds to Indian Patent Application No. 201937004982 and is related to U.S. Appl. No. 16/323,635.

* cited by examiner

WORKING MACHINE AND METHOD FOR WORKING THE GROUND

BACKGROUND

Field of Invention

The invention relates to a working machine, in particular a construction machine, having a mast, along which, by means of a positioning means, a rotary head is vertically movable, by which a telescopic Kelly rod having at least two Kelly bars is guided in a displaceable manner, wherein an outer Kelly bar designed for being supported on the rotary head and an inner Kelly bar are provided which comprises a rope suspension for a rope, by which the inner Kelly bar is vertically movable by means of a main rope winch, wherein, for the purpose of torque transmission, Kelly bars are provided on their external and/or internal sides with axially running drive keys as well as locking recesses on the drive keys and/or axial latch elements which can be moved into the locking recesses for axially locking the Kelly bars or moved out of the locking recesses for unlocking, in accordance with the preamble of claim 1.

The invention further relates to a method for working the ground with a working machine, having a mast, along which, by means of a positioning means, a rotary head is moved vertically, by which a telescopic Kelly rod having at least two Kelly bars is displaced and guided, wherein an outer Kelly bar that is supported on the rotary head and an inner Kelly bar are provided that is suspended on a rope, by which the inner Kelly bar is moved vertically by means of a main rope winch, wherein, for the purpose of torque transmission, the Kelly bars are provided on their external and/or internal sides with axially running drive keys as well as locking recesses on the drive keys and/or axial latch elements which are moved into the locking recesses for axially locking the Kelly bars or moved out of the locking recesses for unlocking, in accordance with the preamble of claim 7.

Description of Related Art

A Kelly rod is a telescopic tool rod which is composed of several tubular bar elements and has at least an outer Kelly bar and an inner Kelly bar. The inner Kelly bar, and thus the Kelly rod as a whole, is suspended on a rope, with the Kelly rod being guided by a Kelly guide and/or an annular rotary drive, also referred to as rotary head. Via the Kelly rod a torque can be transmitted from the rotary drive to a ground working tool, in particular a drilling tool, that is mounted on the lower end of the inner Kelly bar. Through a corresponding outward-telescoping of the individual Kelly bar elements with respect to each other greater drilling depths can also be reached.

For the torque transmission the individual Kelly bar elements have on their external side and their internal side axially running stop ledges that serve for the torque transmission. Moreover, in particular axial positions, especially in a starting and end region, locking recesses or latch elements are provided, through which the Kelly bar elements can be secured axially with respect to each other. In this way, axial compressive forces can also be applied via the drill drive to the Kelly rod and therefore the ground working tool. The outer Kelly bar can also be connected in an axially fixed manner to the drill drive.

Especially when working the ground in a discontinuous manner, for instance when producing a bore with a drilling bucket, the drilling bucket has to be moved repeatedly into the borehole and out of it again. Depending on the respective borehole depth the Kelly rod is accordingly telescoped inwards and outwards repeatedly. After filling of the drilling bucket with removed ground material this has to be withdrawn from the borehole for emptying. For this purpose, the individual Kelly bar elements have to be unlocked again and retracted into each other. In this retracted position the Kelly rod can be withdrawn from the borehole together with the drilling bucket and pivoted to an emptying position. Afterwards, for a further drilling step the drilling tool is moved into the borehole again with a renewed outward-telescoping of the Kelly rod.

The inward- and outward-telescoping of a Kelly rod requires time and skill on the part of the operator of the drilling apparatus. Usually, the locking positions are concealed so that the operator of the drilling apparatus is not able to identify where the latch element and a locking recess are located. It is known that the position of the individual Kelly bar elements with respect to each other is displayed to the operator of the drilling apparatus on his operating monitor. However, such displays are very complex from a control engineering viewpoint and require a precise calibration of the individual drive components and of the positions of the Kelly rod before commencement of drilling. Moreover, which type of Kelly rod is being used must be entered into the control.

A method for monitoring a Kelly drill rod is known from DE 10 2012 019 850 A1.

BRIEF SUMMARY

The invention is based on the object to provide a working machine and a method for working the ground which permit an especially efficient working with a Kelly rod.

The object is achieved on the one hand by a working machine having the features of claim 1 and on the other hand by a method having the features of claim 7. Preferred embodiments of the invention are stated in the respective dependent claims.

The working machine according to the invention is characterized in that a control is provided which is designed for the automatic locking and/or unlocking of the Kelly bar, in that by means of a first detection means a rotation angle of at least one Kelly bar can be detected and/or by means of a second detection means a force, torque or pressure change can be detected in a drive system, by which the positioning means, the rotary head and/or the main rope winch are driven, and in that the control is designed to determine a locking and/or unlocking of the Kelly bars depending on the detected rotation angle and/or the detected force, torque or pressure change.

A basic idea of the invention resides in the fact that a control is provided which is designed for the automatic locking and/or unlocking of the Kelly bars. By means of a first detection means a rotation angle of at least one Kelly bar can be detected. A latch element of a first Kelly bar can be applied with a certain slight pressure to the drive key of a second opposite Kelly bar. During a relative axial movement of the two Kelly bars with respect to each other the rotation angle initially remains the same. As soon as the latch element, during this axial movement, reaches a locking recess, which constitutes an axial recess along the drive key, the latch element rotates into the locking recess. This abrupt change of the rotation angle can be detected by the first detection means as an indication that a locking has taken place. The change of the rotation angle can be detected in a direct manner by suitable angle encoders, such as incremental encoders, or in an indirect manner by way of a force, torque or pressure change in the drive system of the rotary drive e.g. as a temporary load drop. The drive system can be designed as an electric or preferably as a hydraulic drive system.

According to a further aspect of the invention, alternative or additional provision is made in that by means of a second detection means a force, torque or pressure change is detected in the drive system, by which the positioning means, the rotary head and/or the main rope winch are driven. When a latch element locks into a locking recess two adjoining Kelly bars are interlocked. A simple axial movement of the latch element is then no longer possible which can be ascertained in the form of a corresponding power increase in the drive system of the axial drive unit. The axial displacement of the two Kelly bars with respect to each other can take place via the positioning means, the rotary head and/or the main rope winch. Depending on which drive unit is used e.g. the pressure in the respective hydraulic system or in the entire system can be monitored and a possible pressure increase can thus be detected. The same applies in the reverse order to an unlocking.

Depending on the detected rotation angle and/or the detected power change the control can thus reliably determine a locking and/or unlocking of the Kelly bar.

In the simplest case the Kelly rod consists of only two Kelly bars, namely a tubular outer Kelly bar and an inner Kelly bar arranged therein in a displaceable manner. To reach greater drilling depths it is advantageous in accordance with a further development of the invention that the Kelly rod has one or several intermediate Kelly bars that are arranged between the outer Kelly bar and the inner Kelly bar. In particular, Kelly rods having three or four Kelly bars are preferred.

Basically, the working machine according to the invention with the Kelly rod can be used for a variety of operations. According to a further development of the invention it is particularly expedient that on a lower end of the inner Kelly bar a drilling tool, in particular a drilling bucket or an auger, is mounted in a releasable manner. Such drilling tools can be employed for discontinuous drilling, in which a Kelly rod has to be extended and retracted repeatedly.

Another preferred embodiment of the invention resides in the fact that at least one input means is provided, with which a type and/or size of the Kelly rod, a position of the positioning means for the rotary head, a position of the rope and/or a type and/or size of the rotary head can be entered. In the simplest case, an input can be carried out via an input terminal. Alternatively, the positions can be detected automatically by means of sensors. Furthermore, it is possible to place the respective components into a defined starting position and to calibrate the working machine with these components. A preferred further development of the invention can be seen in the fact that the first detection means has a rotation angle encoder for detecting a rotation angle. By preference, the rotation angle encoder is integrated in the rotary head. However, provision can be made for any other sensor arrangements that are suitable for a direct or indirect detection of the rotation angle.

Another expedient embodiment variant of the invention resides in the fact that the second detection means has a pressure sensor for detecting a pressure increase. The pressure sensor can preferably be provided in a pressure line in the respective hydraulic system. By preference, the pressure sensor is located close to the component, the pressure of which is to be monitored in order to control the locking.

The method according to the invention is characterized in that by means of a control the Kelly bars are locked or unlocked automatically, that by means of a first detection means a rotation angle of at least one Kelly bar is detected and/or by means of a second detection means a force, torque or pressure change is detected in a drive system, by which the positioning means, the rotary head and/or the main rope winch are driven, and in that by the control a locking and/or unlocking of the Kelly bars is determined depending on the detected rotation angle and/or the detected force, torque or pressure change.

The method according to the invention can be implemented, in particular, with a working machine as described previously. Accordingly, the advantages described beforehand can be achieved.

An advantageous method variant of the invention resides in the fact that for the locking and/or unlocking a ground working tool on the Kelly rod is placed onto the ground, in particular onto a borehole bottom. In doing so, the ground working tool and the inner Kelly bar firmly connected thereto are located in a defined position. By preference, the outer Kelly bar or an intermediate Kelly bar according to the invention can now be moved relative to the inner Kelly bar until the desired locking or unlocking is realized. Basically, the method according to the invention can be used for every application, in which a tool with a Kelly rod is required. According to an embodiment variant it is especially preferred that a borehole is produced in the ground. The production of the borehole can be carried out by excavating the ground material.

According to a further embodiment variant of the invention provision is made in that the borehole is filled to form a foundation element. In the simplest case, the foundation element can be filled with a pourable material, such as sand or gravel. By preference, the foundation element is formed by filling a hardenable mass, more particularly a concrete material.

According to a further development of the method pursuant to the invention it is of advantage that for the locking of a Kelly bar a first torque is applied thereto, wherein a latch element is applied with slight pressure to a drive key of the opposite Kelly bar, and in that the two Kelly bars are moved axially relative to each other until the latch element rotates in the circumferential direction into a locking recess and/or abuts axially. The relative pressing-on between latch element and drive key takes place with an initial slight pressure that is predetermined by the control. In doing so, the pressure is set such that the two Kelly bars can still be moved axially relative to each other with relatively small frictional forces. When the latch element passes by a locking recess, the latch element rotates into the locking recess in the circumferential direction. This locking can be ascertained both by a change of the rotation angle between the two opposite Kelly bars and by a pressure change in the axial drive unit. Through the control an axial displacement of the two Kelly bars to each other is then set automatically. Where required, a further axial movement can take place if a further locking with another Kelly bar is desired.

According to the invention another method variant resides in the fact that the Kelly bar with the latch element is moved axially relative over a predetermined distance. The predetermined distance can range from some ten centimeters to a few meters. If, on running across this predetermined distance, no locking is ascertained, the movable Kelly bar can be reset by the control to the starting point, with an axial movement being once more effected over the predetermined distance. This process can be repeated once or several times.

Should there still be no locking, an error indication or a request to carry out the locking in a conventional manner can be prompted to the operator of the drilling apparatus.

BRIEF DESCRIPTION OF THE DRAWINGS

The invention is explained further hereinafter by way of preferred embodiments illustrated schematically in the drawings, wherein show.

DETAILED DESCRIPTION

Figure 1:
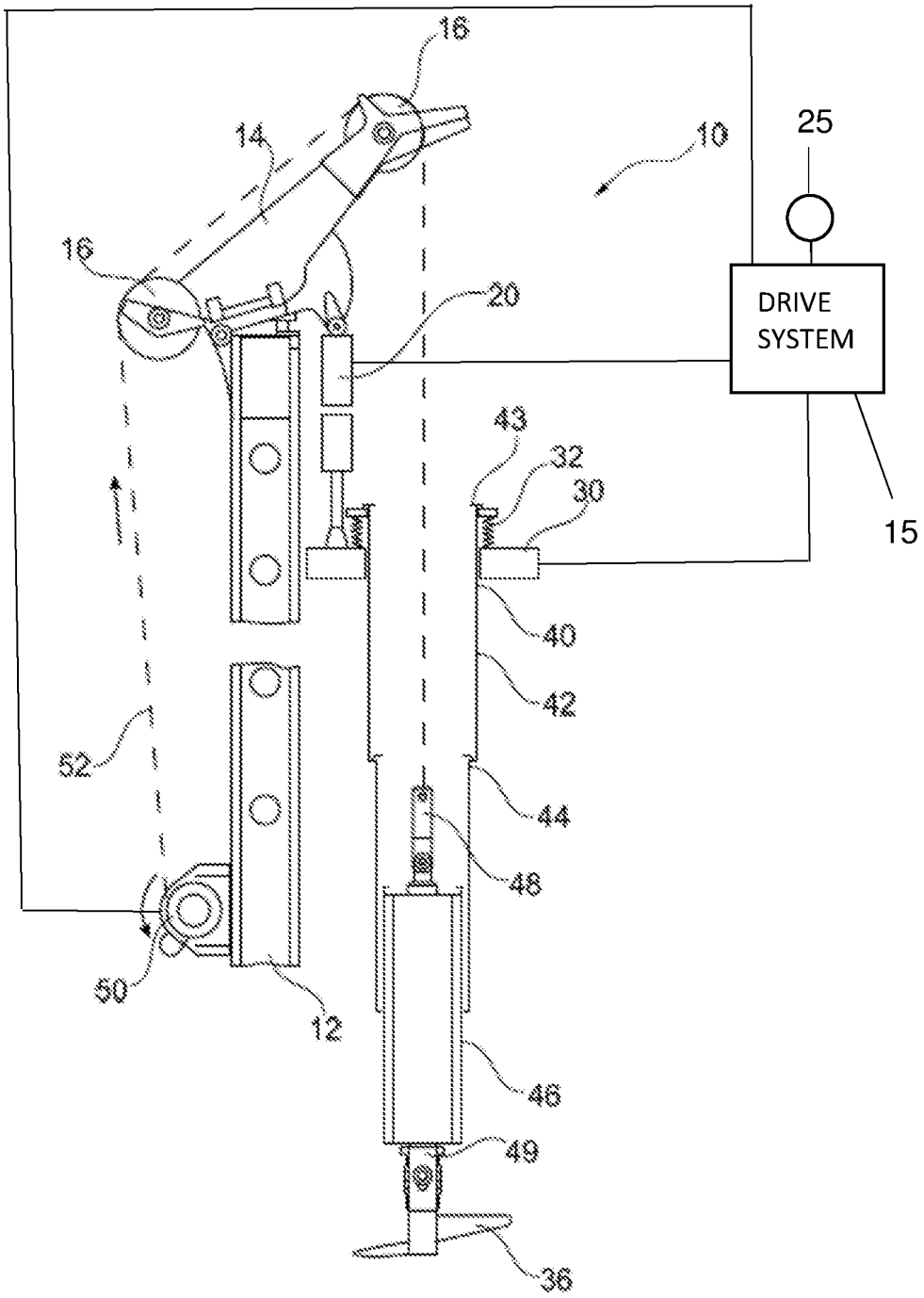
FIG. 1 a schematic partial view of a first working machine according to the invention.
Figure 2:
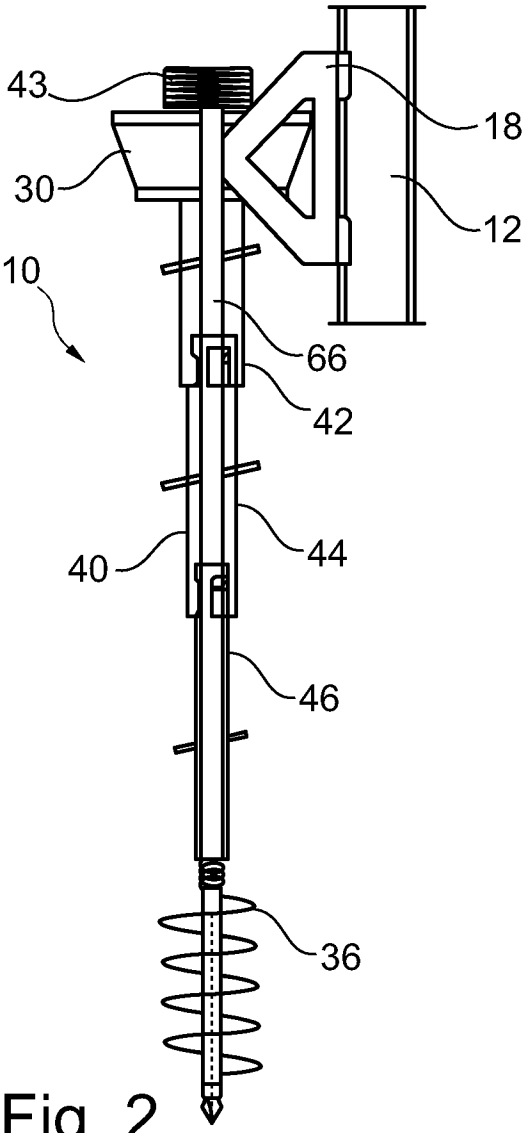
FIG. 2 a schematic partial view of a second working machine according to the invention.

The working machine 10 according to FIGS. 1 and 2 has in each case a substantially vertical mast 12 that possesses a mast head 14 each which is only depicted in FIG. 1. Via a rope 52 driven by a main rope winch 50 and guided via deflection rollers 16 on the mast head 14 a Kelly rod 40 is suspended in a vertically displaceable manner along the mast 12.

According to the two embodiments pursuant to FIGS. 1 and 2 the Kelly rod 40 is in each case designed with an upper-lying outer Kelly bar 42, a lower-lying inner Kelly bar 46 and an intermediate Kelly bar 44 arranged in-between. On the upper end of the inner Kelly bar 46 a rope suspension 48 is provided, on which the rope 52 is designed for the vertical displacement of the inner Kelly bar 46 and of the further tubular Kelly bar elements.

At its upper end the outer Kelly bar 42 has a supporting collar 43, with which the outer Kelly bar 42 is supported on a rotary head 30, i.e. an annular rotary drive. For the damping of shocks a damping means 32 with springs is arranged between the rotary head 30 and the supporting collar 43 in the embodiment according to FIG. 1. The rotary head 30 and therefore the outer Kelly bar 42 can be moved vertically along the mast 12 via a positioning means 20. In the embodiment according to FIG. 1 the positioning means 20 is designed as a hydraulic cylinder. To transmit the torque from the rotary head 30 to the outer Kelly bar 42 and therefore to the Kelly rod 40 as a whole drive keys 66 are arranged on the outer Kelly bar 42 on the external side thereof, as can be seen in FIG. 2.

In a known manner, corresponding drive keys 66 or latch elements are also arranged on the other external sides and internal sides of the further Kelly bar elements. On a lower side of the inner Kelly bar 46 a pin-shaped connection element 49 is provided, with which a ground working tool 36 can be mounted in a torque-proof manner. In the embodiments according to FIGS. 1 and 2 the ground working tool 36 is designed as an auger.

Figure 4:
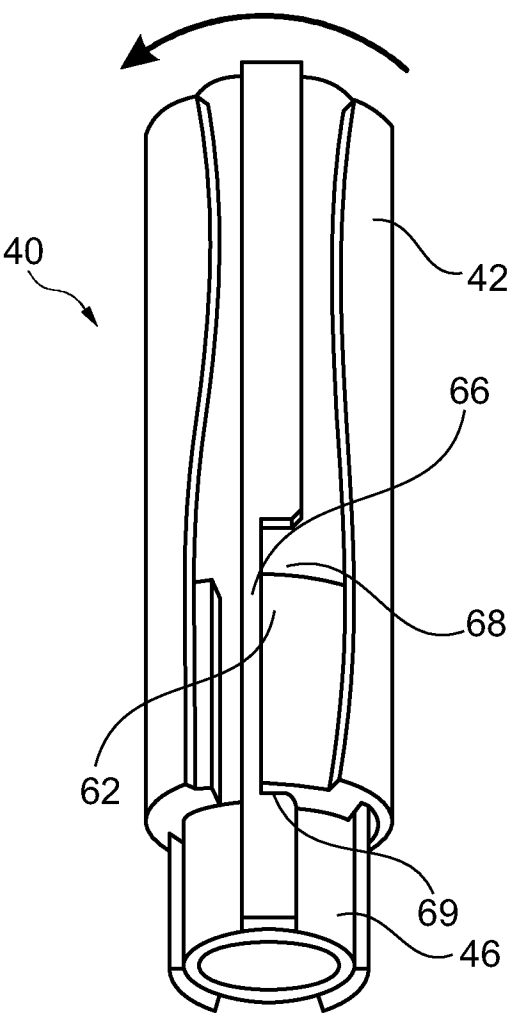
FIG. 4 a schematic broken-away illustration of the Kelly rod of FIG. 3 after locking.
Figure 3:
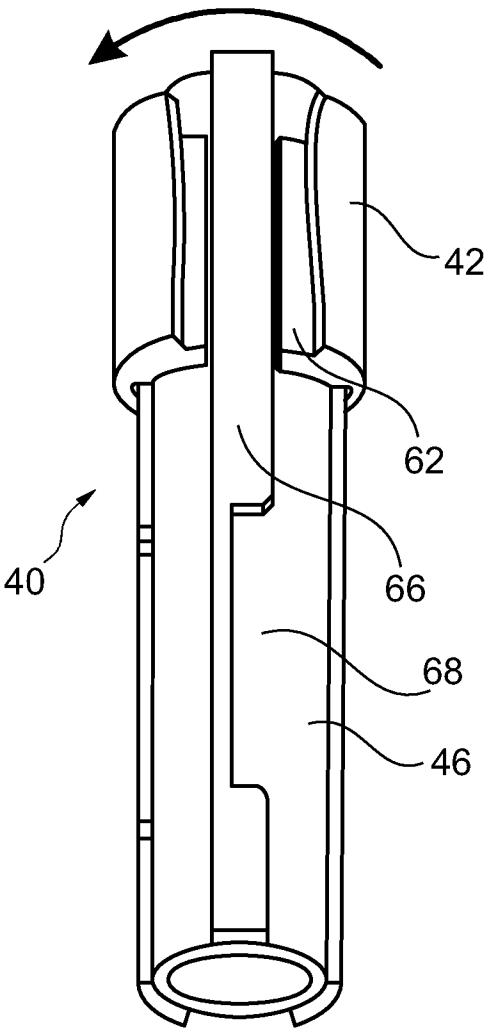
FIG. 3 a schematic broken-away illustration of a Kelly rod before unlocking.

In FIGS. 3 and 4 a simplified Kelly rod 40 with an outer Kelly bar 42 and an inner Kelly bar 46 is illustrated. For the torque transmission from the outer Kelly bar 42 to the inner Kelly bar 46 the outer Kelly bar 42 has on its internal side at least one latch element 62 which rests in the circumferential direction against an axially running drive key 66 on the external side of the inner Kelly bar 46.

For an axial locking of the outer Kelly bar 42 and the inner Kelly bar 46 the latch element 62 on the outer Kelly bar 42 is pressed lightly against the drive key 66 by applying a slight torque via the rotary head 30 by means of a control according to the invention. In this pressed-on position the outer Kelly bar 42 and the inner Kelly bar 46 are now moved axially to each other either via the positioning means 20 or the main rope winch 50. When the position illustrated in FIG. 4 is reached, the outer Kelly bar 42 with the latch element 62, on reaching a locking recess 68 designed as an axial recess in the drive key 66, rotates counter-clockwise in the circumferential direction into the locking recess 68 in the illustrated embodiment. In doing so, a twisting takes place between the outer Kelly bar 42 and the inner Kelly bar 46 which can be ascertained by a first detection means, in particular a sensor means, as an indication for a locking.

Upon further axial movement of the outer Kelly bar 42 with respect to the inner Kelly bar 46 the block-like latch element 62 abuts axially against an axial stop 69 of the locking recess 68. A further axial movement of the outer Kelly bar 42 is now no longer possible or only with an increased expenditure of force which can be detected as a pressure increase in the hydraulic system 15, by which the axial drive member is driven. Likewise, an abutment of the latch element 62 in the circumferential direction against a lateral surface of the locking recess 68 can also be ascertained as a pressure change, a force change or a torque change by means of a second detection means 25, such as a pressure sensor, a force sensor or a torque sensor, in the hydraulic system 15 for driving the rotary head. These respective pressure, force or torque changes can be detected as a further indication for the presence of a successful locking of the Kelly bars and registered by the control.

The invention claimed is:

1. A working machine, comprising:

a mast, a hydraulic cylinder, a rotary head that is vertically movable by the hydraulic cylinder, a telescopic Kelly rod having at least two Kelly bars configured to be guided in a displaceable manner by the rotary head, the at least two Kelly bars comprising:

an outer Kelly bar designed for being supported on the rotary head, and an inner Kelly bar which comprises a rope suspension for a rope, the inner Kelly bar being vertically movable by means of a main rope winch, wherein, each of the at least two Kelly bars include, on their external and/or internal surfaces, axially running drive keys and locking recesses on the drive keys or latch elements configured to move into the locking recesses for axially locking the at least two Kelly bars or moved out of the locking recesses to unlock the at least two Kelly bars in order to transmit torque from the rotary head to a ground working tool, and a drive system, by which at least the hydraulic cylinder, the rotary head or the main rope winch are driven, wherein:

a controller is provided which is configured for the locking and/or unlocking of the Kelly bars, the controller is configured such that:

a first torque can be applied to one of the at least inner or outer Kelly bars, wherein a latch element is applied with pressure to the axially running drive key of another of the inner and outer Kelly bars, and the at least two Kelly bars are moved axially relative to each other until the latch element rotates in the circumferential direction into a locking recess, the working machine further comprising a detector arranged in the drive system or in the hydraulic cylinder configured to detect a force, torque or pressure change in the drive system indicating rotation of the Kelly bars, and wherein the controller is configured to determine the locking of the Kelly bars depending on the detected force, torque or pressure change in the drive system, and wherein the force, torque or pressure change is indicated by a temporary load drop measured by the detector.

2. The working machine according to claim 1, wherein the Kelly rod comprises at least one intermediate Kelly bar that is arranged between the outer Kelly bar and the inner Kelly bar.

3. The working machine according to claim 1, wherein the ground working tool is mounted in a releasable manner on a lower end of the inner Kelly bar.

4. The working machine according to claim 1, further comprising at least one input configured to enter a type and/or size of the Kelly rod, a position of the hydraulic cylinder for the rotary head, a position of the rope and/or a type and/or size of the rotary head.

5. The working machine according to claim 1, wherein the detector has a pressure sensor for detecting a pressure increase.

6. A method for working the ground with the working machine according to claim 1, wherein the Kelly bars are locked or unlocked by the controller, a first torque is applied to one of the inner and outer Kelly bars, wherein a latch element is applied with pressure to the axially running drive key of another of the inner and outer Kelly bars, the two Kelly bars are moved axially relative to each other until the latch element rotates in the circumferential direction into the locking recess, a force, torque or pressure change in the drive system is detected during rotation, and the locking of the Kelly bars is determined depending on the detected force, torque, or pressure change.

7. The method according to claim 6, wherein the ground working tool on the Kelly rod is placed onto the ground for locking and/or unlocking the Kelly bars.

8. The method according to claim 6, wherein a borehole is produced in the ground.

9. The method according to claim 8, wherein the borehole is filled to form a foundation element.

10. The method according to claim 6, wherein the Kelly bar with the latch element is moved axially relative over a predetermined distance.

* * * * *